US005749154A

United States Patent [19]

Scharf

[11] Patent Number: 5,749,154

[45] Date of Patent: May 12, 1998

[54] BULL NOSE CORNER MARKING APPARATUS

[76] Inventor: Robert E. Scharf, 145 E. 200 South, Manti, Utah 84642

[21] Appl. No.: 650,494

[22] Filed: May 20, 1996

[51] Int. Cl.[6] ..... B43L 7/027

[52] U.S. Cl. ..... 33/563; 33/474; 33/429

[58] Field of Search ..... 33/452, 456, 459, 33/474, 475, 478, 479, 563, 407–409, 429, 476, 480, 482, 535, 562, 566; D10/61, 62, 64, 65, 71

[56] References Cited

U.S. PATENT DOCUMENTS

| | | | |
|---|---|---|---|
| 363,331 | 5/1887 | Hammer | 33/485 |
| 513,665 | 1/1894 | Barberie | 33/474 |
| 1,682,035 | 8/1928 | Clark, Jr. | 33/474 |
| 3,276,128 | 10/1966 | Ponich | 33/613 |
| 4,138,819 | 2/1979 | Sosin | 33/476 |
| 5,396,710 | 3/1995 | Battaglia | 33/429 |
| 5,524,353 | 6/1996 | Fink | 33/452 |

FOREIGN PATENT DOCUMENTS

| | | | |
|---|---|---|---|
| 1163437 | 3/1984 | Canada | 33/479 |

*Primary Examiner*—William A. Cuchlinski, Jr.
*Assistant Examiner*—Andrew Hirshfeld
*Attorney, Agent, or Firm*—Foster & Foster

[57] ABSTRACT

A bull nose corner marking apparatus includes a body having a first section and a second section joined perpendicularly relative to one another for placing about an outside corner of a wall. The first section and second section define an internal area corresponding to the shape of a bull nose corner end molding piece. Through utilization of the marking apparatus, proper markings can quickly be made on an outside corner of a wall. In addition, a bull nose corner end molding piece can be quickly measured and marked for completing the construction of a bull nose corner molding location.

19 Claims, 3 Drawing Sheets

BULL NOSE CORNER MARKING APPARATUS

TECHNICAL FIELD

This invention relates to tools and implements used in construction, and more particularly, to measuring and marking devices used in the construction industry.

BACKGROUND OF THE INVENTION

A constant challenge in the construction industry is to build quickly, beautifully, and inexpensively. Particularly with respect to finish carpentry, efforts are continually being made to develop tools, methods, and other construction systems that increase the speed and efficiency of the construction, yet allow the construction worker to maintain high-quality construction standards.

Recently, the construction industry has seen an increase in the demand for creative and more unique construction techniques. One technique that has re-emerged is rounding outside corners of walls to create so-called bull nose corners. Bull nose corners are becoming more common and popular in new construction. Any type of molding used where bull nose corners exist, such as without limitation baseboard molding, corner molding, and wainscot, must be specially cut to fit properlay around the bull nose corners.

Carpenters using methods of forming molding around bull nose corners have faced particular problems and difficulties. For example, the edge locations of the molding pieces approaching a bull nose corner must be positioned at specific, precise locations to prevent unsightly gaps from resulting between the bull nose corner piece and the molding pieces converging toward the bull nose corner. Cutting the particular bull nose end molding piece also involves several difficulties, which have traditionally been addressed by laborious and slow methods involving measuring, marking, and cutting. Aligning and assmbling the bull nose corner end molding piece with the other molding pieces also involves significant precision to ensure that the pieces fit together properly. Known methods of marking, measuring, cutting, and installing molding around a bull nose corner have been slow and cumbersome, typically involving tedious and imprecise use of a tape measure and a marking implement, such as a pencil. There is much room for error, and the processes are slow.

In view of the foregoing, a significant need exists for a tool that will allow rapid marking and measuring of locations on walls forming an outside bull nose corner where molding pieces are to be secured. There is also a substantial need for a tool that will facilitate the fabrication of the particular molding pieces used to construct a bull nose corner molding location.

OBJECTS AND SUMMARY OF THE INVENTION

It is an object of the present invention to provide a bull nose corner marking apparatus that will enable rapid marking of locations on walls forming an outside bull nose corner where molding pieces are to be mounted for constructing a bull nose corner molding location.

Another object of the invention is to provide a bull nose corner marking apparatus that is lightweight and easy to use.

Still another object of the invention is to provide a bull nose corner marking apparatus that is inexpensive to manufacture.

Yet another object of the invention is to provide a bull nose corner marking apparatus that includes angled edges that can be used to mark the proper angles at which the various molding pieces should be cut to form a bull nose corner molding location.

Another object of the invention is to provide a bull nose corner marking apparatus that includes a chisel end for removing excess drywall compound at a corner location in order to properly construct a bull nose corner molding location.

Still another object of the invention is to provide a bull nose corner marking apparatus that can be placed on a pie-cut edge of a molding piece for cutting a bull nose corner end molding piece used to construct a bull nose corner molding location.

Yet another object of the invention is to provide a bull nose corner marking apparatus that substantially eliminates the need to use a tape measure in constructing the bull nose corner molding location.

The foregoing objects are achieved by a bull nose corner marking apparatus which includes a body having a first section and a second section extending perpendicularly from the first section. An intersection location is formed at the junction of the first section and the second section. The intersection location defines an inner area that corresponds in shape to a bull nose corner end molding piece. The internal area is in the form of a trapezoid having a back edge and opposed side edges being angled at 22½ degrees relative to the back edge. The angled side edges correspond to the outside edges of a bull nose corner end molding piece used to construct a bull nose corner molding location. A pair of marking locations are also provided at the intersection location. The marking locations are positionable on adjoining sides of walls to correspond to edge locations of pieces of molding to be secured to the walls at a bull nose corner molding location.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
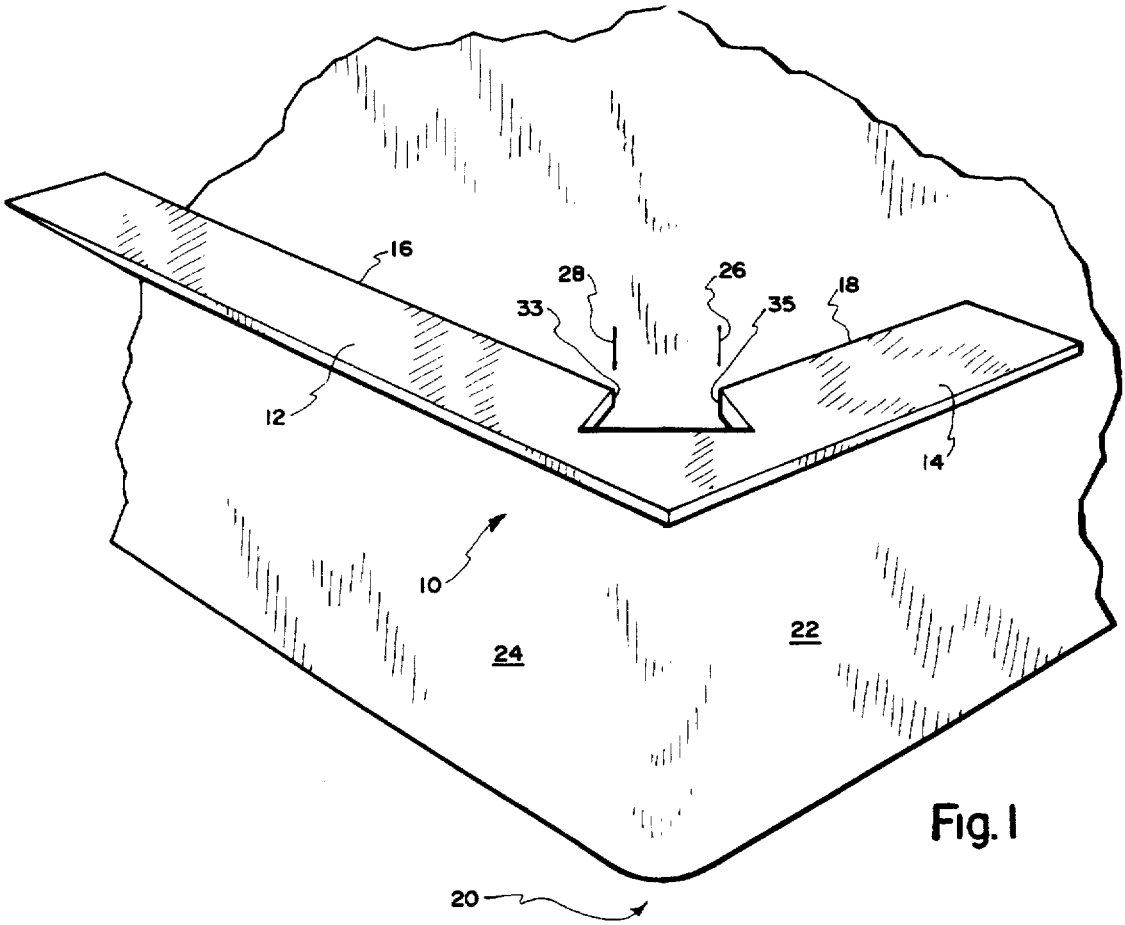
FIG. 1 is an isometric view of a bull nose corner marking apparatus according to the present invention positioned over an outside bull nose corner.

The invention, as shown in FIGS. 1–6, relates to a bull nose corner marking apparatus 10 comprising a body having a first section 12 and a second section 14. The first section and the second section extend at a right angle or perpendicularly relative to one another. The first and second sections join to form a corner location 13 (FIG. 2) which results in a right angle with respect to an outside edge 17 of the first section 12 and an outside edge 19 of the second section 14. The first section 12 also includes an inner edge 16. Similarly, the second section 14 includes an inner edge 18. Inside edges 16, 18 are at right angles relative to one another and are intended to bear against adjoining sides of walls forming an outside bull nose corner 20. As shown in FIG. 1, inside edge 18 is positioned against wall 22, and inside edge 16 is positioned against wall 24.

Figure 2:
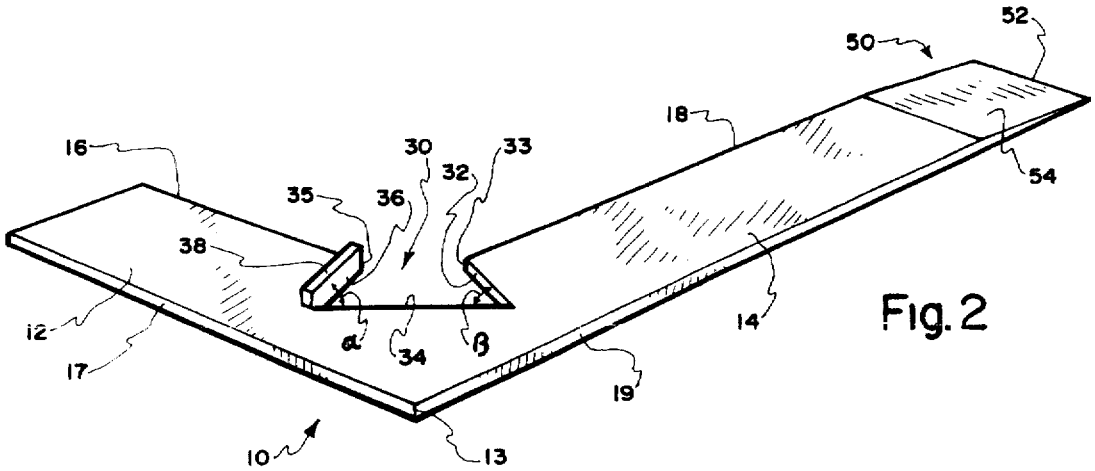
FIG. 2 is an upside down, reversed isometric view of the bull nose corner marking apparatus of FIG. 1.
Figure 3:
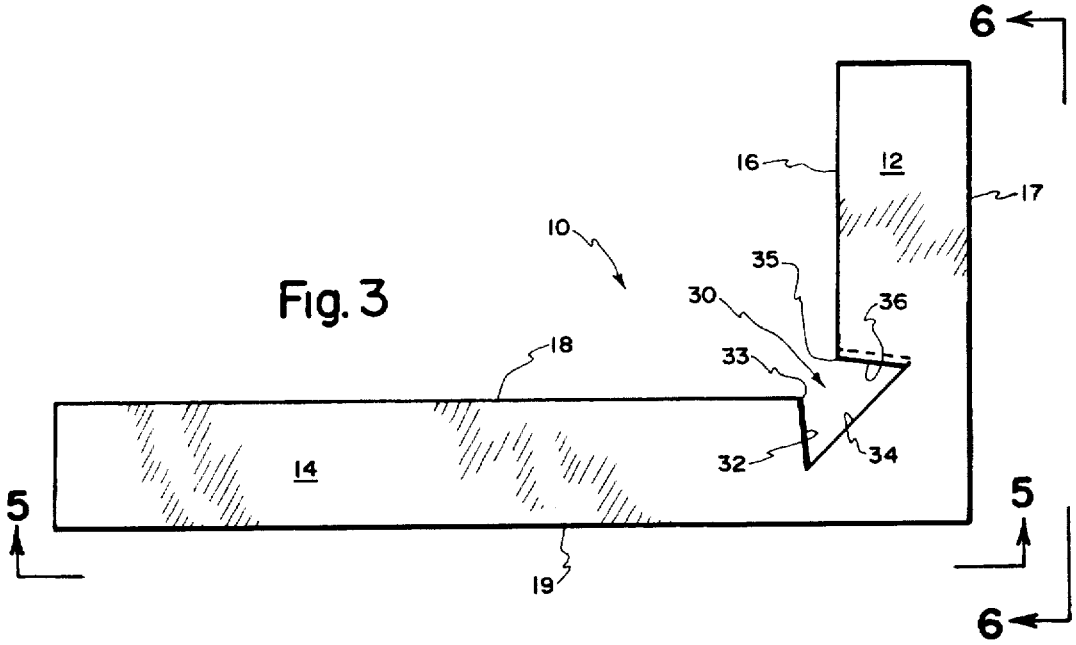
FIG. 3 is a top view of the bull nose corner marking apparatus of FIG. 1.

As shown in FIG. 2, an internal or inner area 30 is defined by the bull nose corner marking apparatus at an intersection location formed by the first section and the second section. Internal area 30 is generally in the form of a trapezoid having a first angled side edge 32, a back or connecting edge 34, and a second angled side edge 36. Side edge 32 and inner edge 18 join at a marking point 33. Inner edge 16 and angled edge 36 join to form a marking point 35. When the bull nose corner marking apparatus is placed around an outside corner of a wall, marking points 33 and 35 correspond to edge locations of pieces of molding to be secured to the walls at a bull nose corner molding location. The above-referenced trapezoid is completed by an imaginary line extending between corner 33 and corner 35.

A primary purpose of the bull nose corner marking apparatus is to enable marking of the walls 22, 24 with appropriate marks 26, 28 corresponding to locations at which molding pieces should be mounted to the walls. The marks 26, 28 are made by referencing the marking points 33, 35 provided at the intersection location 30 (FIG. 2).

Also as shown in FIG. 2, a reference lip 38 extends downwardly from the first section 12. The inner edge of lip 38 corresponds to angled edge 36 formed in the first section. The purpose of the downwardly extending lip 38 is provided to assist in marking a piece of molding for cutting a bull nose corner end molding piece, which will be explained in greater detail below.

The opposed side edges 32, 36 preferably correspond to the measurements of a bull nose corner end molding piece used to form a bull nose corner molding location. Preferably, angle $\alpha$ is 22½ degrees, and angle $\beta$ is 22½ degrees. It is to be understood that other angles and inner edge contours may be used without departing from the scope of the present invention.

Figure 4:
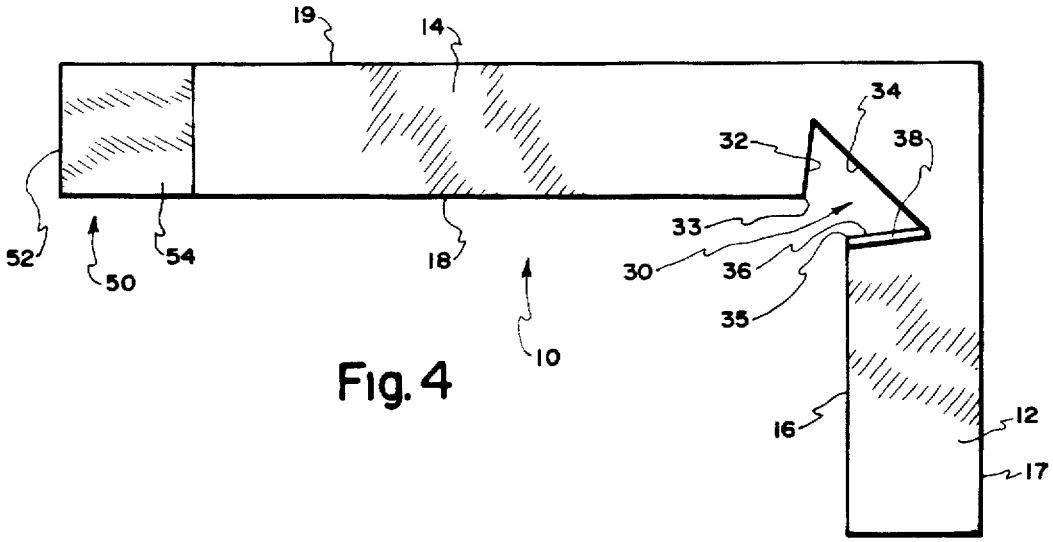
FIG. 4 is a bottom view of a bull nose corner marking apparatus of FIG. 1.
Figure 5:
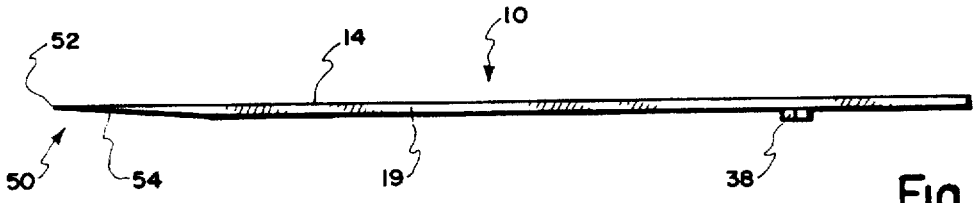
FIG. 5 is a front elevation view of the bull nose corner marking apparatus of FIG. 1.
Figure 6:
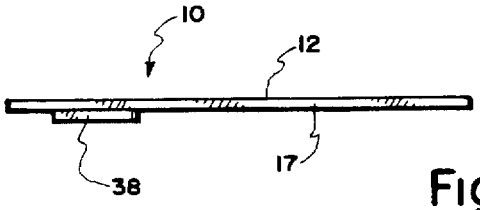
FIG. 6 is a right side elevation view of the bull nose corner marking apparatus of FIG. 1.

A chisel end 50 is formed at one end of the bull nose corner marking apparatus, as shown in FIGS. 2 and 4–5. The chisel end comprises a sloped surface 54 which terminates at a chisel edge 52. The chisel end may be used to remove excess wallboard compound remaining at the base of the walls 22, 24 after being finished by the dry wall crew. Typically, where drywallers know that base boards are going to be installed along the bottom of a wall, they often let mud slop down at the lower extremes of the walls.

Figure 7:
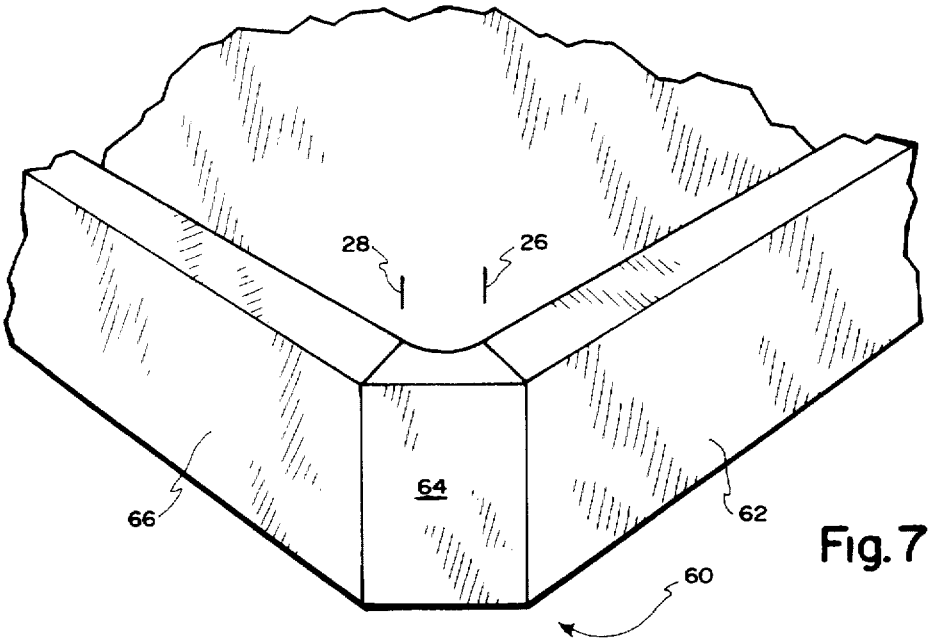
FIG. 7 is an isometric view of a bull nose corner molding location formed about an outside bull nose corner.

FIG. 7 shows one type of a bull nose corner molding location 60 which comprises a first molding piece 62, a second molding piece 66, and a bull nose corner end molding piece 64. As can be seen, the edge of the molding piece 62 and the edge molding piece 66 will be aligned to correspond with markings 26, 28 on the wall. Provided these molding boards have angled ends of 22½ degrees, and provided they are aligned with markings 26, 28, the bull nose corner end molding piece 64 should fit in place properly without any sightly gaps where the molding pieces join.

Figure 8:
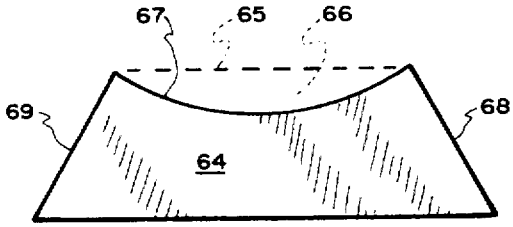
FIG. 8 is a top view of a bull nose corner end molding piece constructed using the bull nose corner marking apparatus of FIG. 1.

FIG. 8 shows a top view of a bull nose corner piece 64. As explained, edges 68 and 69 correspond with the 22½ degree angles $\alpha$, $\beta$ formed in the bull nose corner marking apparatus. The typical trapezoid is formed by angled edges 68, 69, as well as the edges (including edge 65 shown in phantom) that connect to angled edges 68, 69. If necessary, material forming inside edge 65 can be removed (the inner portion 71—also shown in phantom) by means of a belt sander or other removing device to form a rounded inner edge 67. Inner edge 67 will allow the bull nose corner end piece 64 to be properly positioned about the outside corner and properly abut the angled edges of molding pieces 62, 66.

Figure 9:
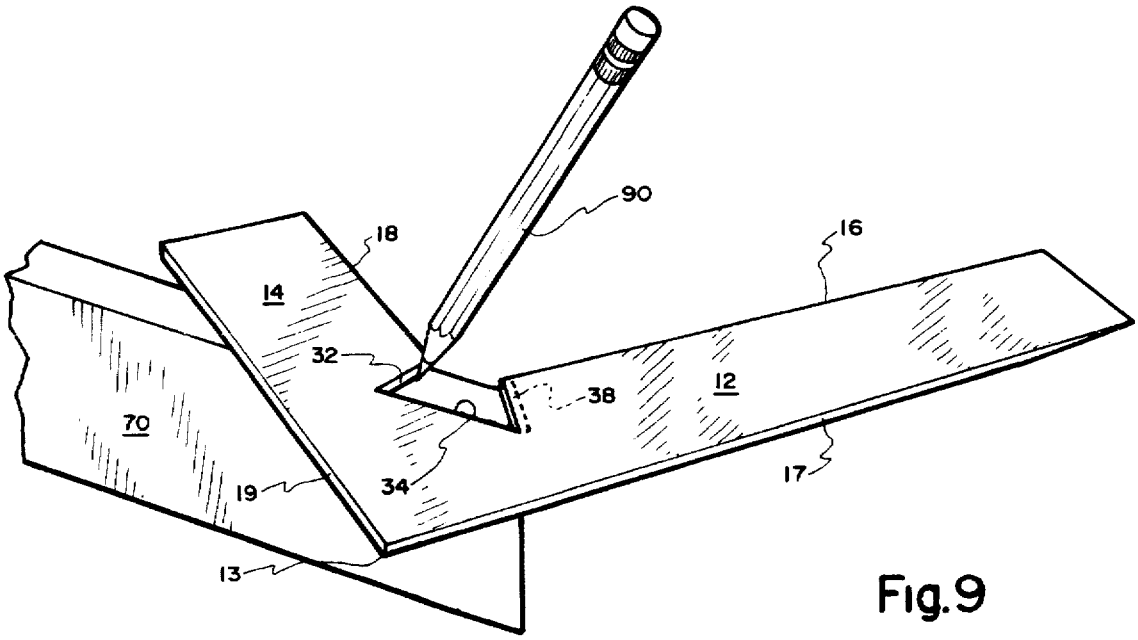
FIG. 9 is a top perspective view of the bull nose corner marking apparatus placed on top of a piece of molding for measuring and marking a bull nose corner end molding piece similar to what is shown in FIG. 8.

FIG. 9 shows a process for cutting a bull nose corner end molding piece. First, an angled edge is cut on a standard piece of molding 70 at an angle of 22½ degrees. Thereafter, the lip 38 (which corresponds to an angle of 22½ degrees) is placed against the angled edge cut in the piece of molding. Thereafter, a pencil or other writing or inscribing instrument is used to draw a straight edge along inside angled edge 32. This straight edge also corresponds to a 22½ degree edge. The resulting piece will form a bull nose corner end piece 64, as shown in FIGS. 7, 8, that can be mated inside two opposite edges of molding pieces to form a bull nose corner molding location.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications with the proper scope of the appended claims appropriately interpreted in accordance with the doctrine of equivalents.

I claim:

1. A bull nose corner marking apparatus, comprising:

a first section;

a second section coupled to the first section;

an intersection location formed by the first section and the second section, the intersection location defining an area corresponding to an outside bull nose corner molding piece, the intersection location allowing a person to mark a piece of molding to cut an outside bull nose corner molding piece.

2. A bull nose corner marking apparatus according to claim 1 wherein the area defined by the intersection location comprises a trapezoid.

3. A bull nose corner marking apparatus according to claim 1, further comprising a marking point provided at the intersection location, the marking point positionable on a wall to correspond to an edge location of the corner molding piece for securing the corner molding piece to the wall at a bull nose corner molding location.

4. A bull nose corner marking apparatus according to claim 1, further comprising a pair of marking points provided at the intersection location, the marking points positionable on adjoining sides of walls to correspond to edge locations of the corner molding piece for securing the corner molding piece to the walls at a bull nose corner molding location.

5. A bull nose corner marking apparatus according to claim 1 wherein the area comprises a trapezoid having a back edge and opposed side edges extending from the back edge at angles of 22½ degrees relative to the back edge.

6. A bull nose corner marking apparatus according to claim 5 further comprising a lip aligned with and extending from one of the side edges, the lip allowing the marking apparatus to be positioned against an edge of the piece of molding for marking the piece of molding.

7. A bull nose corner marking apparatus according to claim 5, further comprising a reference lip aligned with one of the side edges, the reference lip allowing the marking apparatus to be placed against an edge of a piece of molding cut at 22½ degrees to mark an opposite 22½ degree edge thereon.

8. A bull nose corner marking apparatus according to claim 1 wherein the first section includes a first section inner edge and the second section includes a second section inner edge, the first section inner edge and the second section inner edge forming generally a right angle relative to one another to allow the marking apparatus to be placed over an outside corner of adjoining walls to mark a bull nose corner molding location.

9. A bull nose corner marking apparatus according to claim 1 further comprising a chisel end formed on one of the first section and the second section.

10. A bull nose corner marking apparatus, comprising:

a body having a first inner edge and a second inner edge, the first inner edge and the second inner edge being positionable along adjoining walls forming an outside corner;

an inner area formed in the body, the inner area dimensionally corresponding to a bull nose corner molding piece.

11. A bull nose corner marking apparatus according to claim 10 wherein the inner area defined by the body comprises a trapezoid.

12. A bull nose corner marking apparatus according to claim 10, further comprising a marking point provided at the inner area, the marking point positionable on one of the walls to correspond to an edge location of the corner molding piece for securing the corner molding piece to the one wall at a bull nose corner molding location.

13. A bull nose corner marking apparatus according to claim 10, further comprising a pair of marking points provided at the inner area, the marking points positionable on adjoining sides of the walls to correspond to edge locations of the corner molding piece for securing the corner molding piece to the walls at a bull nose corner molding location.

14. A bull nose corner marking apparatus according to claim 10 wherein the inner area comprises a trapezoid having a back edge and opposed side edges extending from the back edge at angles of 22½ degrees relative to the back edge.

15. A bull nose corner marking apparatus according to claim 14, further comprising a lip aligned with and extending from one of the side edges, the lip allowing the marking apparatus to be positioned against an edge of a piece of molding for marking the molding.

16. A bull nose corner marking apparatus according to claim 14, further comprising a reference lip aligned with one of the side edges, the reference lip allowing the marking apparatus to be placed against an edge of a piece of molding cut at 22½ degrees to mark an opposite 22½ degree edge on the piece of molding.

17. A bull nose corner marking apparatus according to claim 10 wherein the body comprises a first section and a second section, the first section including the first inner edge and the second section including the second inner edge, the first inner edge and the second inner edge forming generally a right angle relative to one another to allow the marking apparatus to be placed over the outside corner of the adjoining walls to mark a bull nose corner molding location.

18. A bull nose corner marking apparatus according to claim 10, further comprising a chisel end formed on the body.

19. A bull nose corner marking apparatus, comprising:

a body including a first section having a first inner edge and a second section having a second inner edge, the first inner edge and the second inner edge being positionable along adjoining walls forming an outside corner;

an intersection location formed by the first section and the second section, the intersection location defining an area corresponding to an outside bull nose corner molding piece, the intersection location allowing a person to mark a piece of molding to cut an outside bull nose molding corner piece;

a pair of marking points provided at the intersection location, the marking points positionable on adjoining sides of the walls to correspond to edge locations of the piece of molding for securing the piece of molding to the walls at a bull nose corner molding location.

* * * * *